US011333403B2

(12) United States Patent
Fukaya et al.

(10) Patent No.: US 11,333,403 B2
(45) Date of Patent: May 17, 2022

(54) THERMOACOUSTIC TEMPERATURE CONTROL SYSTEM

(71) Applicant: CENTRAL MOTOR WHEEL CO., LTD., Anjoh (JP)

(72) Inventors: Noriyuki Fukaya, Anjoh (JP); Takeshi Ito, Anjoh (JP); Ryuujyu Kase, Anjoh (JP)

(73) Assignee: CENTRAL MOTOR WHEEL CO., LTD., Anjoh (JP)

( * ) Notice: Subject to any disclaimer, the term of this patent is extended or adjusted under 35 U.S.C. 154(b) by 77 days.

(21) Appl. No.: 16/643,994

(22) PCT Filed: Sep. 6, 2017

(86) PCT No.: PCT/JP2017/032013
§ 371 (c)(1),
(2) Date: Mar. 3, 2020

(87) PCT Pub. No.: WO2019/049221
PCT Pub. Date: Mar. 14, 2019

(65) Prior Publication Data
US 2021/0063058 A1 Mar. 4, 2021

(51) Int. Cl.
*F25B 9/00* (2006.01)
*F25B 9/14* (2006.01)

(52) U.S. Cl.
CPC ..... *F25B 9/002* (2013.01); *F25B 9/145* (2013.01); *F25B 2309/1403* (2013.01);
(Continued)

(58) Field of Classification Search
CPC ..... F25B 2309/1403; F25B 2309/1405; F25B 9/145; F25B 2309/1409
See application file for complete search history.

(56) References Cited

U.S. PATENT DOCUMENTS 10,844,847 B2 * 11/2020 Fukaya ..... F03G 7/002
2014/0338369 A1 * 11/2014 Hasegawa ..... F25B 9/145 62/6
2016/0084239 A1 * 3/2016 Miyairi ..... H02K 35/06 60/530

FOREIGN PATENT DOCUMENTS

JP H05-346192 A 12/1993
JP 2002-535597 A 10/2002
(Continued)

*Primary Examiner* — Lionel Nouketcha
(74) *Attorney, Agent, or Firm* — Oliff PLC

(57) ABSTRACT

A system includes: a piping with a working gas encapsulated therein and a prime mover and load incorporated in the piping. The prime mover includes a prime mover-side heat accumulator and heat exchangers connected to opposite end portions of the heat accumulator. The load includes a load-side heat accumulator and heat exchangers connected to opposite end portions of the heat accumulator. The piping includes a looped piping portion having a looped shape and a branch piping portion branching from a branching point p in the looped piping portion, and the prime mover is incorporated in the branch piping portion and load is incorporated in the looped piping portion. A blocking film is inserted at a position in a vicinity of the branching point p. Consequently, a thermoacoustic temperature control system that enables enhancement in durability of a blocking film inserted in a part of a looped piping portion is provided.

3 Claims, 8 Drawing Sheets

(52) U.S. Cl.
CPC ..... *F25B 2309/1405* (2013.01); *F25B 2309/1409* (2013.01); *F25B 2700/21* (2013.01)

(56) References Cited

FOREIGN PATENT DOCUMENTS

| | | | | |
|---|---|---|---|---|
| JP | 2006-322475 | A | | 11/2006 |
| JP | 2011-127738 | A | | 6/2011 |
| JP | 2012-159266 | A | | 8/2012 |
| JP | 2013-117321 | A | | 6/2013 |
| JP | 2013-117324 | A | | 6/2013 |
| JP | 2013-117325 | A | | 6/2013 |
| JP | 2013117324 | A | * | 6/2013 |
| JP | 5799515 | B2 | | 10/2015 |
| WO | 00/43639 | A1 | | 7/2000 |

* cited by examiner

THERMOACOUSTIC TEMPERATURE CONTROL SYSTEM

TECHNICAL FIELD

The present invention relates to a thermoacoustic temperature control system.

BACKGROUND ART

Conventionally, thermoacoustic temperature control systems in which a prime mover and a load are incorporated in a piping with a working gas encapsulated therein have been known (see, for example, Patent Literature 1). The prime mover includes a prime mover-side heat accumulator and prime mover-side heat exchangers connected to opposite end portions, in an extension direction of the piping, of the prime mover-side heat accumulator. The load includes a load-side heat accumulator and load-side heat exchangers connected to opposite end portions, in the extension direction of the piping, of the load-side heat accumulator.

This thermoacoustic temperature control system can be used as a thermoacoustic refrigeration system in which a refrigerator is employed as a load or a thermoacoustic heating system in which a heater is employed as a load. For example, the aforementioned literature describes a thermoacoustic refrigeration system in which a refrigerator is employed as a load. In this thermoacoustic refrigeration system, at the prime mover, a temperature gradient is generated between the opposite end portions of the mover-side heat accumulator, using heat of a fluid provided from the outside to the prime mover-side heat exchanger (for example, exhaust heat from a plant), the fluid having a temperature that is higher than room temperature. The temperature gradient makes the working gas perform self-excited vibration and thermal energy is thereby converted into acoustic energy (vibrational energy) inside the prime mover-side heat accumulator.

On the other hand, at the load (refrigerator), a temperature gradient is generated between opposite end portions of the load-side heat accumulator, using the acoustic energy transmitted to the load-side heat accumulator through the piping. This temperature gradient produces the working gas having a temperature that is lower than room temperature. As a result of the working gas having a temperature that is lower than room temperature being supplied to the load-side heat exchanger, a temperature of an object connected to the load-side heat exchanger is lowered and the object is thus maintained at a low temperature.

CITATION LIST

Patent Literature

Patent Literature 1: Japanese Patent No. 5799515

SUMMARY OF THE INVENTION

The aforementioned literature indicates an example of a thermoacoustic refrigeration system in which a piping includes a looped piping portion having a looped shape and a branch piping portion extending so as to branch from a part of the looped piping portion, a prime mover is incorporated in the branch piping portion and a load is incorporated in the looped piping portion (see, for example, FIG. 6 in Patent Literature 1).

Generally, in a looped piping portion, an acoustic mass flow of a working gas is generated because of a pressure difference (temperature difference) inside the looped piping portion. Therefore, in the configuration in which a load is incorporated in a looped piping portion, an acoustic mass flow passes through the inside of the load. The passage of the acoustic mass flow through the inside of the load makes it impossible to form an ideal temperature gradient between opposite end portions of a load-side heat accumulator because of the movement of the working gas.

In order to solve this problem, in the thermoacoustic refrigeration system indicated in the aforementioned literature, a blocking film is inserted at a position in the vicinity of a load-side heat exchanger on the low temperature side of the looped piping portion. The blocking film prohibits an acoustic mass flow (working gas) from passing therethrough and is capable of vibrating along with vibration of the working gas and thus allows transmission of a vibrational wave (vibrational energy) of the working gas. Therefore, the insertion of the blocking film as above enables solving the aforementioned problem while allowing transmission of vibrational energy.

Here, since the blocking film vibrates along with vibration of the working gas, stress repeatedly acts on the blocking film. Therefore, there is a problem in durability of the blocking film. Regarding this point, the above literature discloses a technique in which the blocking film is disposed in the vicinity of a position a distance that is half of a maximum amplitude of the blocking film away from the load-side heat exchanger on the low temperature side, in the looped piping portion. The technique prevents interference between the load-side heat exchanger on the low temperature side and the blocking film, enabling enhancement in durability of the blocking film.

On the other hand, for enhancement in durability of the blocking film, unlike in the above literature, the present inventor looked at distribution in magnitude of acoustic energy (vibrational energy) inside the looped piping portion. Then, the present inventor has obtained knowledge on conditions for enhancement in durability of the blocking film from the perspective of the distribution in magnitude of acoustic energy inside the looped piping portion.

The present invention has been made in view of the above point and an object of the present invention is to provide a thermoacoustic temperature control system that enables enhancement in durability of a blocking film inserted in a part of a looped piping portion.

In a thermoacoustic temperature control system according to the present invention, as in the above, a prime mover including a prime mover-side heat accumulator and prime mover-side heat exchangers and a load including a load-side heat accumulator and load-side heat exchangers are incorporated in a piping with a working gas encapsulated therein. Then, the piping includes a looped piping portion having a looped shape and a branch piping portion branching from a branching point that is a part of the looped piping portion, the prime mover is incorporated in the branch piping portion and the load is incorporated in the looped piping portion.

A characteristic of the thermoacoustic temperature control system according to the present invention lies in that a blocking film that prohibits the working gas from passing therethrough and is capable of vibrating along with vibration of the working gas is inserted at a position in the vicinity of the branching point, in a part of the looped piping portion between the load-side heat exchanger on the low temperature side and the branching point.

Acoustic energy (vibrational energy) formed by the prime mover incorporated in the branch piping portion reaches the branching point via the branch piping portion and then makes a circuit of the looped piping portion from the branching point in a direction in which the acoustic energy passes through the inside of the load from the high temperature side to the low temperature side, and after reaching the branching point again, merges with acoustic energy newly reaching the branching point via the branch piping portion and circulates in the looped piping portion again.

Here, distribution in magnitude of the acoustic energy (vibrational energy) inside the looped piping portion is looked at. When the acoustic energy moves inside the piping, the magnitude of the acoustic energy is gradually decreased because of energy loss that inevitably occurs. Therefore, the magnitude of the acoustic energy becomes gradually smaller as the acoustic energy moves from the branching point to the looped piping portion, and reaches a minimum immediately before the acoustic energy reaching the branching point again, and at a point of time when the acoustic energy has reached the branching point again, becomes larger again because of merging with new acoustic energy and subsequently becomes gradually smaller as stated above. In other words, in the looped piping portion, the magnitude of the acoustic energy reaches a maximum at the branching point and reaches a minimum at a position in the vicinity of the branching point, between the load-side heat exchanger on the low temperature side and the branching point.

On the other hand, for enhancement in durability of the blocking film, maximum stress acting on the blocking film may be reduced. In order to reduce the maximum stress acting on the blocking film, a maximum amplitude of the blocking film may be reduced. In order to reduce the maximum amplitude of the blocking film, the magnitude of the acoustic energy (vibrational energy) passing through the blocking film may be reduced. In other words, insertion of the blocking film at a position at which the acoustic energy reaches a minimum inside the looped piping portion enables enhancement in durability of the blocking film to the extent possible.

The above-stated characteristic of the thermoacoustic temperature control system according to the present invention is based on such knowledge. In other words, inserting the blocking film at a position in the vicinity of the branching point, in the part of the looped piping portion between the load-side heat exchanger on the low temperature side and the branching point enables inserting the blocking film at a position at which the acoustic energy reaches a minimum inside the looped piping portion. As a result, the durability of the blocking film can be enhanced to the extent possible.

In the thermoacoustic temperature control system according to the present invention, it is preferable that: each of respective end portions of three parts of the piping, the three parts converging from three directions toward the branching point, may be connected to a corresponding connection end portion of three connection end portions of a three-way piping joint; and the blocking film may be directly inserted between an end portion of a part of the piping, the part extending from the load-side heat exchanger on the low temperature side toward the branching point and the corresponding connection end portion of the connection end portions of the three-way piping joint.

According to the above, the blocking film is directly attached to the corresponding connection end portion of the three connection end portions of the three-way piping joint. Therefore, the configuration in which "the blocking film is inserted at a position in the vicinity of the branching point, in the part of the looped piping portion between the load-side heat exchanger on the low temperature side and the branching point" can easily be provided.

Also, instead of the blocking film alone, a blocking film sub-assembly including the blocking film and a pair of ring-like holding members that hold the blocking film so as to sandwich the blocking film from opposite sides may be directly inserted between an end portion of a part of the piping, the part extending from the load-side heat exchanger on the low temperature side toward the branching point and the corresponding connection end portion of the connection end portions of the three-way piping joint.

According to the above, when the blocking film is replaced, the blocking film sub-assembly may be replaced instead of the blocking film alone. In the blocking film sub-assembly, the blocking film is protected by the pair of holding members, and thus, handling of the blocking film is easy in comparison with the blocking film alone. Therefore, in comparison with the case where the blocking film is replaced alone, ease of the work of replacement is enhanced. Furthermore, in preparation for future replacement of the blocking film, a number of blocking films can be kept not in the state of blocking films alone but in the state of blocking film sub-assemblies. Therefore, ease of keeping the blocking films is enhanced in comparison with the case where the blocking films are kept alone.

Also, in the thermoacoustic temperature control system according to the present invention, it is preferable that a length, from the connection end portion connected to the end portion of the part of the piping, the part extending from the load-side heat exchanger on the low temperature side toward the branching point, to the branching point, of the three-way piping joint be shorter than a length, from the connection end portion connected to an end portion of a part of the piping, the part extending from the load-side heat exchanger on the high temperature side connected to an end portion on the high temperature side of the opposite end portions, in the extension direction of the piping, of the load-side heat accumulator, toward the branching point, to the branching point, of the three-way piping joint.

According to the above, the blocking film can be brought further closer to the branching point in comparison with a case where as the three-way piping joint, one having a length, from an connection end portion connected to the end portion of the part of a piping, the part extending from the load-side heat exchanger on the low temperature side toward the branching point to the branching point, the length being larger than a length, from a connection end portion connected to the end portion of the part of the piping, the part extending from the load-side heat exchanger on the high temperature side toward the branching point, to the branching point, thereof is used. As a result, the blocking film can be inserted at a position at which acoustic energy becomes further smaller inside the looped piping portion, enabling further enhancement in durability of the blocking film.

MODES FOR CARRYING OUT THE INVENTION

A thermoacoustic temperature control system 1 according to an embodiment of the present invention will be described below with reference to the drawings.

Configuration

Figure 1:
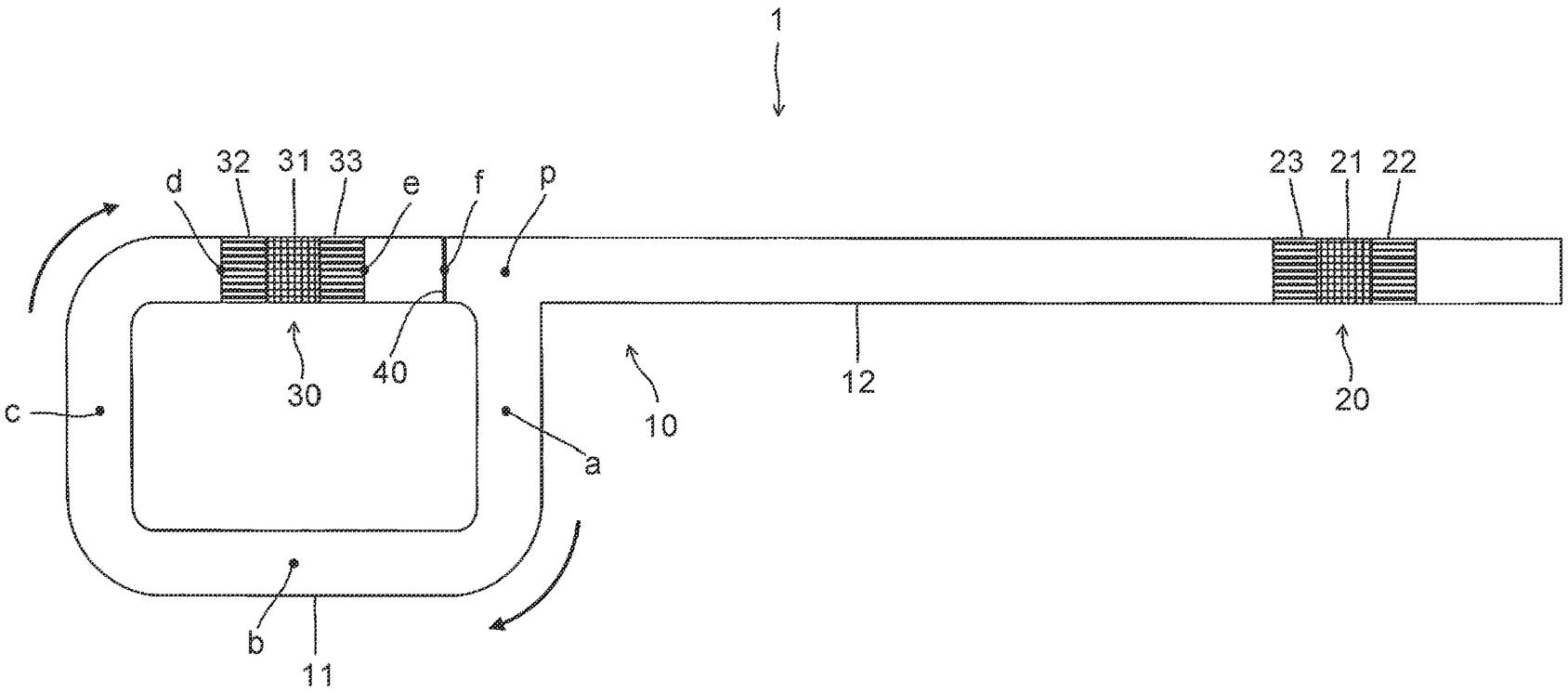
FIG. 1 is a diagram schematically illustrating a thermoacoustic temperature control system according to an embodiment of the present invention.

As illustrated in FIG. 1, the thermoacoustic temperature control system 1 includes a piping 10 made of a metal, a prime mover 20 incorporated in the piping 10, a load 30 incorporated in the piping 10 and a blocking film 40. As described later, the load 30 can function as a refrigerator that maintains a temperature of an object at a temperature that is lower than room temperature (refrigeration temperature) or a heater that maintains a temperature of an object at a temperature that is higher than room temperature. In other words, the thermoacoustic temperature control system 1 has a function that adjusts a temperature of an object connected to the load 30.

The piping 10 includes a looped piping portion 11, which is a piping part having a looped shape, and a branch piping portion 12 that branches from the looped piping portion 11, a space inside the branch piping portion 12 communicating with a space inside the looped piping portion 11. The branch piping portion 12 is a piping part that extends linearly from a branching point p at which the branch piping portion 12 branches from the looped piping portion 11. An end portion in the extension direction of the branch piping portion 12 is sealed by a predetermined sealing member.

The piping 10 is actually formed by joining a plurality of linear pipings and curved pipings using predetermined joining members (typically, bolts and nuts). As described later, a part of the piping 10, the part corresponding to the branching point p, may be used as a three-way piping joint. It is a matter of course that the branch piping portion 12 may be a piping part extending in a curved manner or may be a piping part that is a combination of a piping part extending in a curved manner and a piping part extending linearly.

A predetermined working gas (helium in the present embodiment) is encapsulated under predetermined pressure in the entirety of the piping 10, that is, both of the looped piping portion 11 and the branch piping portion 12. Note that for the working gas, e.g., nitrogen, argon, air or any of mixtures thereof may be employed instead of or in addition to helium.

The prime mover 20 is incorporated at an intermediate point in the branch piping portion 12. The prime mover 20 includes a heat accumulator 21 incorporated inside the branch piping portion 12, a high temperature-side heat exchanger 22 disposed so as to face an end portion on the high temperature side of the heat accumulator 21 and a low temperature-side heat exchanger 23 disposed so as to face an end portion on the low temperature side of the heat accumulator 21. Note that although a single prime mover 20 is provided in the present example, a plurality of prime movers 20 may be incorporated in series in the branch piping portion 12 as necessary.

Figure 2:
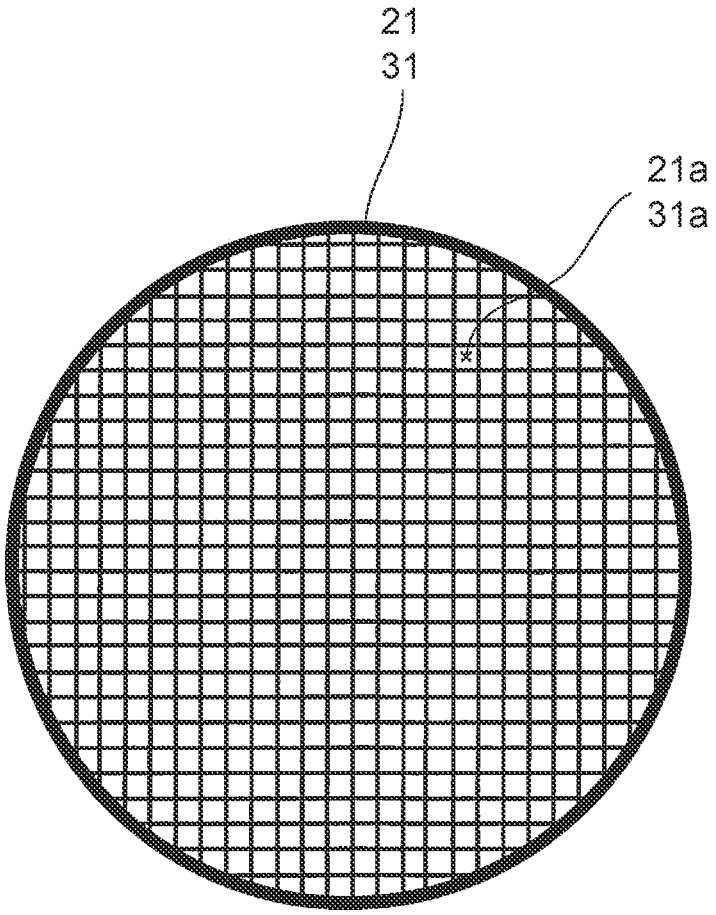
FIG. 2 is a diagram illustrating an example of a section of the prime mover-side heat accumulator and the load-side heat accumulator illustrated in FIG. 1.

As illustrated in FIG. 2, the heat accumulator 21 is, for example, a cylindrical structure having a round shape in a section in a direction perpendicular to the extension direction of the branch piping portion 12. The heat accumulator 21 includes a plurality of through flow channels 21*a* extending parallel to one another along the extension direction of the branch piping portion 12. The working gas vibrates inside the plurality of flow channels 21*a*.

In the example illustrated in FIG. 2, the plurality of flow channels 21*a* are defined and formed in a matrix by a multitude of walls vertically and horizontally partitioning the inside of the heat accumulator 21. Note that as long as a plurality of through flow channels extending in the extension direction of the branch piping portion 12 are formed inside the heat accumulator 21, the inside of heat accumulator 21 may be partitioned in any manner that may be, e.g., a honeycomb manner.

For the heat accumulator 21, typically, e.g., a structure made of ceramic, a structure in which a plurality of mesh thin plate of stainless steel are stacked in parallel with a fine pitches or a non-woven fabric material formed of metal fiber can be used. Note that for the heat accumulator 21, instead of one having a round shape in lateral section, one having, e.g., an elliptical shape or a polygonal shape in lateral section can be employed.

Upon a predetermined temperature gradient being generated between the opposite ends of the heat accumulator 21, the working gas inside the branch piping portion 12 becomes unstable and performs self-excised vibration along the extension direction of the branch piping portion 12. As a result, a vibrational wave (also a referred to as "sound wave", "vibration flow" or "work flow") formed by a longitudinal wave vibrating along the extension direction of the branch piping portion 12 is formed and the vibrational wave is transmitted from the branch piping portion 12 to the looped piping portion 11 via the branching point p.

The high temperature-side heat exchanger 22 is connected to a high temperature-side heat source (illustration omitted) and the low temperature-side heat exchanger 23 is connected to a low temperature-side heat source (illustration omitted) having a temperature that is lower than that of the high temperature-side heat source. Typically, for the high temperature-side heat source and the low temperature-side heat source, a heat source having a temperature that is higher than room temperature and a heat source having a room temperature are used, respectively. As the heat source having a temperature that is higher than room temperature, for example, a heat source relating to exhaust heat from a plant can be used. Note that for the high temperature-side heat source and the low temperature-side heat source, a heat source having room temperature and a heat source having a temperature that is lower than room temperature may be used, respectively.

In the high temperature-side heat exchanger 22, heat exchange is performed between a medium supplied from the high temperature-side heat source and the working gas inside the high temperature-side heat exchanger 22. Consequently, a temperature of the working gas around the end portion on the high temperature side of the heat accumulator 21 is adjusted so as to be close to the temperature of the high temperature-side heat source. In the low temperature-side heat exchanger 23, heat exchange is performed between a medium supplied from the low temperature-side heat source and the working gas inside the low temperature-side heat exchanger 23. Consequently, a temperature of the working gas around the end portion on the low temperature side of the heat accumulator 21 is adjusted so as to be close to the temperature of the low temperature-side heat source. Note that for each of configurations of the high temperature-side heat exchanger 22 and the low temperature-side heat exchanger 23, a configuration of a known heat exchanger can be used.

A temperature gradient is generated between the opposite ends of the heat accumulator 21 by means of cooperation between the high temperature-side heat exchanger 22 and the low temperature-side heat exchanger 23 described above. In other words, the high temperature-side heat exchanger 22 and the low temperature-side heat exchanger 23 form "prime mover-side heat exchangers" that perform heat exchange with the working gas so as to generate a temperature gradient between the opposite end portions of the plurality of flow channels 21*a* of the heat accumulator 21 in order to make the working gas encapsulated in the piping 10 perform self-excited vibration.

The load 30 is incorporated in a part of the looped piping portion 11. The load 30 includes a heat accumulator 31 incorporated inside the looped piping portion 11, a high temperature-side heat exchanger 32 disposed so as to face an end portion on the high temperature side of the heat accumulator 31 and a low temperature-side heat exchanger 33 disposed so as to face an end portion on the low temperature side of the heat accumulator 31.

As illustrated in FIG. 2, the heat accumulator 31 has a configuration that is similar to that of the heat accumulator 21 of the prime mover 20. In other words, the heat accumulator 31 is, for example, a cylindrical structure having a round shape in a section in a direction perpendicular to an extension direction of the looped piping portion 11 and includes a plurality of through flow channels 31*a* extending parallel to one another along the extension direction of the looped piping portion 11. The working gas vibrates inside the plurality of flow channels 31*a*.

Upon a vibrational wave of the working gas, the vibrational wave being generated on the prime mover 20 side, being transmitted to the inside of the heat accumulator 31, a temperature gradient is generated between the opposite end portions of the heat accumulator 31 by acoustic energy provided by the vibrational wave.

Where the load 30 is used as a refrigerator, typically, the high temperature-side heat exchanger 32 is connected to a source having room temperature (illustration omitted) and the low temperature-side heat exchanger 33 is connected to an object to be maintained at a temperature that is lower than room temperature (low temperature). In the high temperature-side heat exchanger 32, heat exchange is performed between a medium supplied from the heat source having room temperature and the working gas inside the high temperature-side heat exchanger 32. Consequently, a temperature of the working gas around the end portion on the high temperature side of the heat accumulator 31 is adjusted so as to be close to room temperature.

As a result, a temperature of the working gas around the end portion on the low temperature side of the heat accumulator 31 is adjusted to a temperature that is an amount of a temperature difference lower than room temperature, the temperature difference corresponding to the temperature gradient generated between the opposite end portions of the heat accumulator 31. As a result of the working gas having the temperature that is lower than room temperature being supplied to the inside of the low temperature-side heat exchanger 33 being supplied, in the low temperature-side heat exchanger 33, heat exchange is performed between the working gas having the temperature that is lower than room temperature and the object. Consequently, a temperature of the object is adjusted so as to be maintained at the low temperature. Note that for each of respective configurations of the high temperature-side heat exchanger 32 and the low temperature-side heat exchanger 33, a configuration of a known heat exchanger can be used.

Where the load 30 is used as a heater, typically, the low temperature-side heat exchanger 33 is connected to a heat source having room temperature (illustration omitted) and the high temperature-side heat exchanger 32 is connected to an object to be maintained at a temperature that is higher than room temperature (high temperature). In the low temperature-side heat exchanger 33, heat exchange between a medium supplied from the heat source having room temperature and the working gas inside the low temperature-side heat exchanger 33 is performed. Consequently, the temperature of the working gas around the end portion on the low temperature side of the heat accumulator 31 is adjusted so as to be close to room temperature.

As a result, the temperature of the working gas around the end portion on the high temperature side of the heat accumulator 31 is adjusted to a temperature that is an amount of a temperature difference higher than room temperature, the temperature difference corresponding to a temperature gradient generated between the opposite end portions of the heat accumulator 31. As a result of the working gas having the temperature that is higher than room temperature being supplied to the inside of the high temperature-side heat exchanger 32, in the high temperature-side heat exchanger 32, heat exchange is performed between the working gas having the temperature that is higher than room temperature and the object. Consequently, the temperature of the object is adjusted so as to be maintained at the high temperature.

As described above, the high temperature-side heat exchanger 32 and the low temperature-side heat exchanger 33 form "load-side heat exchangers" that produce a working gas for adjusting a temperature of an object, the "working gas having a temperature that is lower than room temperature or a temperature that is higher than room temperature", and performs heat exchange between the working gas having the temperature that is lower than room temperature or the temperature that is higher than room temperature and the object to adjust the temperature of the object. Specifically, the high temperature-side heat exchanger 32 forms a "load-side heat exchanger on the high temperature side" and the low temperature-side heat exchanger 33 forms a "load-side heat exchanger on the low temperature side".

The blocking film 40 is inserted in a part of the looped piping portion 11 in order to prevent generation of an acoustic mass flow of the working gas inside the looped piping portion 11. In other words, in a looped piping portion such as the looped piping portion 11, generation of an acoustic mass flow due to a pressure difference (temperature difference) inside the looped piping portion makes the working gas circulate inside the looped piping portion. Note that in a piping portion with an end portion sealed such as the branch piping portion 12, no acoustic mass flow is generated because there is no destination of movement of the working gas. Therefore, in the present configuration, no acoustic mass flow is generated on the prime mover 20 side and an acoustic mass flow can be generated on the load 30 side.

If an acoustic mass flow passes through the inside of the load 30, it becomes impossible to form an ideal temperature gradient between the opposite end portions of the heat accumulator 31 because of movement of the working gas. In order to solve this problem, in the present configuration, the blocking film 40 is inserted in a part of the looped piping portion 11. The blocking film 40 prohibits passage (movement) of the working gas itself and is capable of vibrating along with vibration of the working gas and thus allows transmission of a vibrational wave (thus, acoustic energy or vibrational energy) of the working gas.

Therefore, for the blocking film 40, a degree of airtightness, the degree enabling prohibiting passage (movement) of the working gas itself, and a degree of flexibility (elasticity), the degree enabling a center portion to vibrate in the extension direction of the looped piping portion 11 with a peripheral edge portion fixed are required. For a material forming the blocking film 40, e.g., metal, glass, ceramic, resin, rubber or fiber can be employed.

In the present configuration, the blocking film 40 is inserted at position f in the vicinity of the branching point p, in the part of the looped piping portion 11 between the low temperature-side heat exchanger 33 and the branching point p. The insertion position of the blocking film 40 will be described in detail later.

Operation

Operation of the thermoacoustic temperature control system 1 configured as described above will briefly be described below based on the content of the above description. As illustrated in FIG. 1, in the thermoacoustic temperature control system 1, where the load 30 is used as a refrigerator, the high temperature-side heat exchanger 32 is connected to a heat source having room temperature and the low temperature-side heat exchanger 33 is connected to an object to be maintained at a temperature that is lower than room temperature (low temperature). With this situation, upon activation of the high temperature-side heat exchanger 22 and the low temperature-side heat exchanger 23 of the prime mover 20 and the high temperature-side heat exchanger 32 and the low temperature-side heat exchanger 33 of the load 30, a temperature gradient is generated between the opposite ends of the heat accumulator 21 by means of cooperation between the high temperature-side heat exchanger 22 and the low temperature-side heat exchanger 23. The temperature gradient causes a vibrational wave resulting from self-excited vibration of the working gas to be formed in the heat accumulator 21. This vibrational wave (sound wave) travels in the looped piping portion 11 from the branch piping portion 12 via the branching point p and is transmitted into the heat accumulator 31 of the load 30.

Upon the transmission of the vibrational wave of the working gas into the heat accumulator 31, a temperature gradient is generated between the opposite end portions of the heat accumulator 31 by acoustic energy provided by the vibrational wave. In addition, as a result of the activation of the high temperature-side heat exchanger 32, the temperature of the working gas around the end portion on the high temperature side of the heat accumulator 31 is adjusted to a temperature close to room temperature. As a result, the temperature of the working gas around the end portion on the low temperature side of the heat accumulator 31 is adjusted to a temperature that is an amount of a temperature difference lower than room temperature, the temperature difference corresponding to the temperature gradient between the opposite end portions of the heat accumulator 31. The working gas having the temperature that is lower than room temperature is supplied to the inside of the low temperature-side heat exchanger 33. Therefore, in the low temperature-side heat exchanger 33, heat exchange is performed between the working gas having the temperature that is lower than room temperature and the object. Consequently, a temperature of the object is adjusted so as to be maintained at the low temperature.

On the other hand, where the load 30 is used as a heater, the low temperature-side heat exchanger 33 is connected to a heat source having room temperature and the high temperature-side heat exchanger 32 is connected to an object to be maintained at a temperature that is higher than room temperature (high temperature). As a result, the temperature of the working gas around the end portion on the low temperature side of the heat accumulator 31 is adjusted to a temperature close to room temperature. Therefore, the temperature of the working gas around the end portion on the high temperature side of the heat accumulator 31 is adjusted to a temperature that is an amount of a temperature difference higher than room temperature, the temperature difference corresponding to the temperature gradient between the opposite end portions of the heat accumulator 31. The working gas having the temperature that is higher than room temperature is supplied to the high temperature-side heat exchanger 32. Therefore, in the high temperature-side heat exchanger 32, heat exchange is performed between the working gas having the temperature that is higher than room temperature and the object. Consequently, a temperature of the object is adjusted so as to be maintained at the high temperature.

Note that as described above, in the present configuration, in the branch piping portion 12, no acoustic mass flow is generated because there is no destination of movement of the working gas, and in the looped piping portion 11, no acoustic mass flow is generated as a result of the insertion of the blocking film 40.

Position of Insertion of Blocking Film 40 and Operation and Effects of Blocking Film 40

As described above, the blocking film 40 vibrates along with vibration of the working gas, and thus, stress repeatedly acts on the blocking film 40. Therefore, it is very important to ensure durability of the blocking film 40.

For enhancement in durability of the blocking film 40, the present inventor looked at distribution in magnitude of acoustic energy (vibrational energy) inside the looped piping portion 11. Then, the present inventor obtained knowledge on an insertion position of the blocking film 40 necessary for enhancement in durability of the blocking film 40 from the perspective of the distribution in magnitude of acoustic energy inside the looped piping portion 11. This point will be described below.

Acoustic energy (vibrational energy) formed by the prime mover 20 incorporated in the branch piping portion 12 reaches the branching point p via the branch piping portion 12 and then makes a circuit of the looped piping portion 11 from the branching point p in a direction in which the acoustic energy passes through the inside of the load 30 from the high temperature side to the low temperature side (direction indicated by the two black arrows in FIG. 1). Then, after the acoustic energy that has made the circuit reaching the branching point p again, the acoustic energy merges with acoustic energy newly reaching the branching point p via the branch piping portion 12 and circulates in the looped piping portion 11 again.

Figure 3:
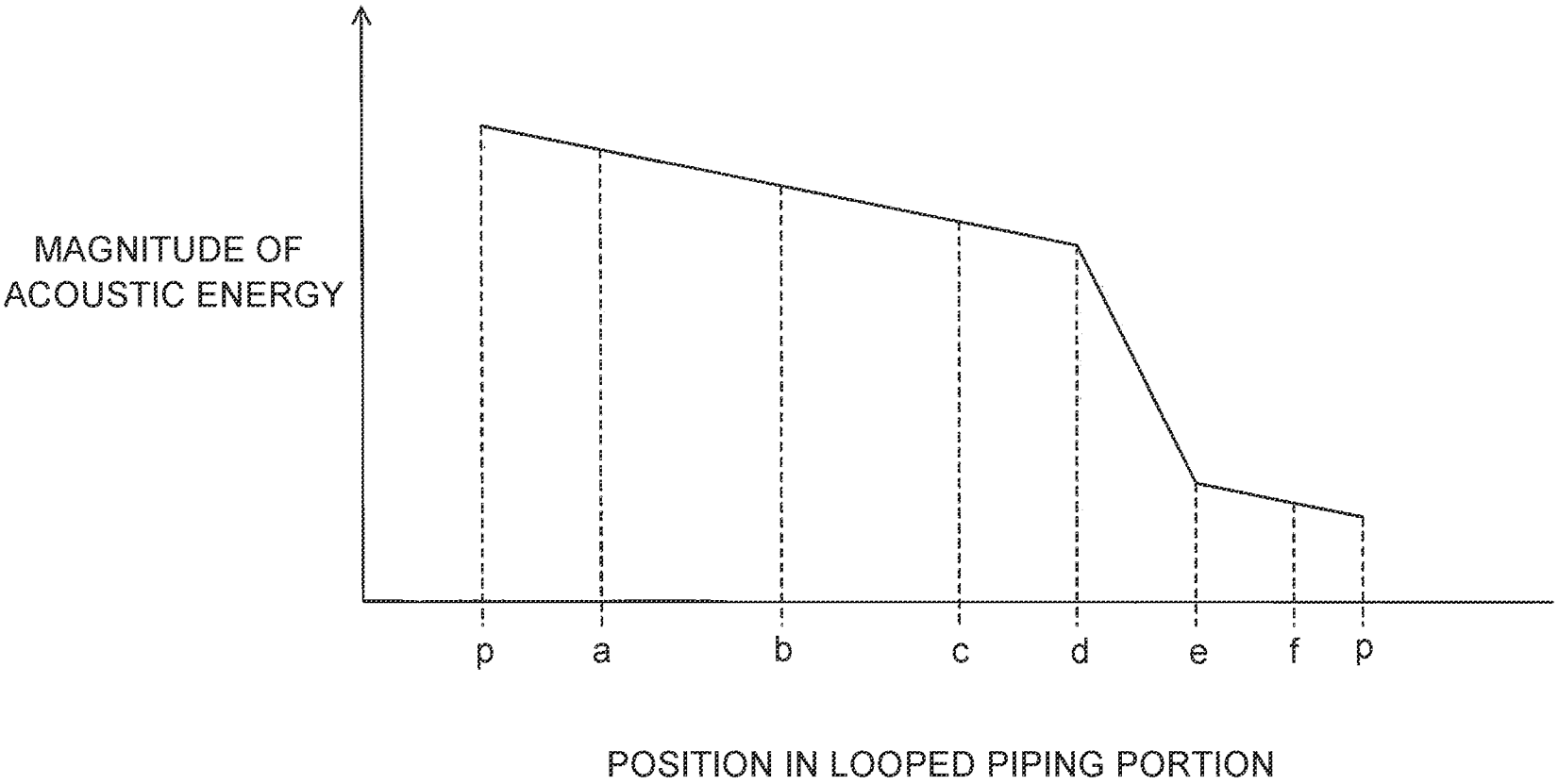
FIG. 3 is a graph illustrating variation in magnitude of acoustic energy relative to positions in the looped piping portion illustrated in FIG. 1.

Here, distribution in magnitude of the acoustic energy (vibrational energy) inside the looped piping portion 11 is looked at. When the acoustic energy moves inside the piping 10, the magnitude of the acoustic energy is gradually decreased because of energy loss that inevitably occurs. Therefore, as illustrated in FIG. 3, the magnitude of the acoustic energy becomes gradually smaller as the acoustic energy moves in the order of points a, b, c, d inside the looped piping portion 11 from the branching point p (for points a to f, see FIG. 1).

Until the acoustic energy that has reached point d (therefore, the high temperature-side end portion of the load 30) reaches point e (the low temperature-side end portion of the load 30), the acoustic energy is partly consumed in order to generate a temperature gradient inside the load 30 and is also partly consumed because of viscous dissipation caused by passage through the plurality of fine flow channels 31*a*. Therefore, a gradient of the decrease of the acoustic energy becomes particularly large between points d and e.

After the acoustic energy reaching point e, the magnitude of the acoustic energy becomes gradually smaller because of the aforementioned energy loss as the acoustic energy moves from point e to the branching point p. As described above, the magnitude of the acoustic energy reaches a minimum immediately before the acoustic energy reaching the branching point p again. Then, at a point of time when the acoustic energy has reached the branching point p again, the acoustic energy becomes larger again because of merging with new acoustic energy and subsequently gradually becomes smaller as described above. In other words, as can be understood from FIG. 3, in the looped piping portion 11, the magnitude of the acoustic energy reaches a maximum at the branching point p and reaches a minimum at a position in the vicinity of the branching point p, between the low temperature-side heat exchanger 33 and the branching point p.

On the other hand, for enhancement in durability of the blocking film 40, maximum stress acting on the blocking film 40 may be reduced. In order to reduce the maximum stress acting on the blocking film 40, a maximum amplitude of the blocking film 40 may be reduced. In order to reduce the maximum amplitude of the blocking film 40, the magnitude of the acoustic energy (vibrational energy) passing through the blocking film 40 may be reduced. In other words, insertion of the blocking film 40 at a position at which the acoustic energy reaches a minimum (magnitude close to a minimum) inside the looped piping portion 11 enables enhancement in durability of the blocking film 40 to the extent possible.

Based on the above knowledge, in the present configuration, as illustrated in FIG. 1, the blocking film 40 is inserted at position fin the vicinity of the branching point p, in the part of the looped piping portion 11 between the low temperature-side heat exchanger 33 and the branching point p. Consequently, the blocking film 40 can be inserted at a position at which the acoustic energy reaches a minimum (magnitude close to a minimum) inside the looped piping portion 11. As a result, the durability of the blocking film 40 can be enhanced to the extent possible.

Figure 4:
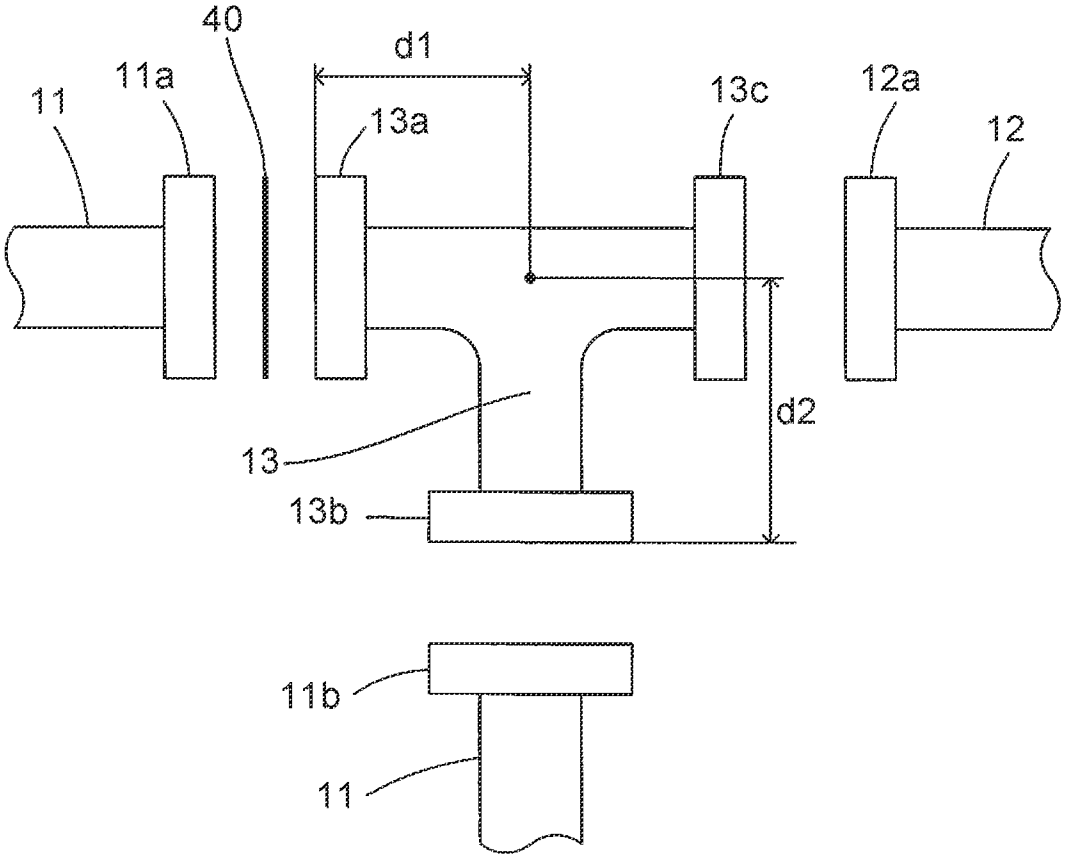
FIG. 4 is a diagram illustrating a specific configuration of piping around a branching point in the thermoacoustic temperature control system illustrated in FIG. 1.

Specific Piping Configuration for Inserting Blocking Film 40 at Position f in Vicinity of Branching Point p In order to easily provide the configuration in which "the blocking film 40 is inserted at position fin the vicinity of the branching point p, in the looped piping portion 11" such as illustrated in FIG. 1, more specifically, as illustrated in FIG. 4, a piping configuration using a three-way piping joint 13 around the branching point p can be employed.

In the example illustrated in FIG. 4, from among three connection end portions 13*a*, 13*b*, 13*c* of the T-shaped three-way piping joint 13, an end portion 12*a* of the branch piping portion 12 is connected to the connection end portion 13*c* corresponding to an end portion of a right-side arm portion of a right-left pair of linearly-extending arm portions of the T-shape, and an end portion 11*a* of the looped piping portion 11 extending from the low temperature-side heat exchanger 33 toward the branching point p is connected to the connection end portion 13*a* corresponding to an end portion of a left-side arm portion of the T-shape, and an end portion 11*b* of the looped piping portion 11 extending from the high temperature-side heat exchanger 32 toward the branching point p is connected to the connection end portion 13*b* corresponding to an end portion of a leg portion of the T-shape.

Then, the blocking film 40 is directly inserted between the end portion 11*a* of the looped piping portion 11 and the connection end portion 13*a* of the three-way piping joint 13. In other words, a circumferential edge portion of the blocking film 40 is directly attached between a ring-like end surface of the end portion 11*a* and a ring-like end surface of the connection end portion 13*a* so as to be in contact with and held between the end surfaces.

The blocking film 40 can be fixed using, for example, predetermined joining members (typically, bolts and nuts) and a predetermined adhesive. As described above, the blocking film 40 being directly attached to the corresponding connection end portion 13*a* of the three-way piping joint enables easily providing the configuration in which "the blocking film 40 is inserted at position f in the vicinity of the branching point p, in the looped piping portion 11.

Here, in the example illustrated in FIG. 4, it is preferable that a length d1, from the connection end portion 13*a* to the branching point p, of the three-way piping joint 13 be shorter than a length d2, from the connection end portion 13*b* to the branching point p, of the three-way piping joint 13. Consequently, the three-way piping joint 13, the length d1 of which is small, can be used, enabling the blocking film 40 to be brought further closer to the branching point p. As a result, the blocking film 40 can be inserted at a position at which acoustic energy becomes further smaller inside the looped piping portion 11, enabling further enhancement in durability of the blocking film 40.

Figure 5:
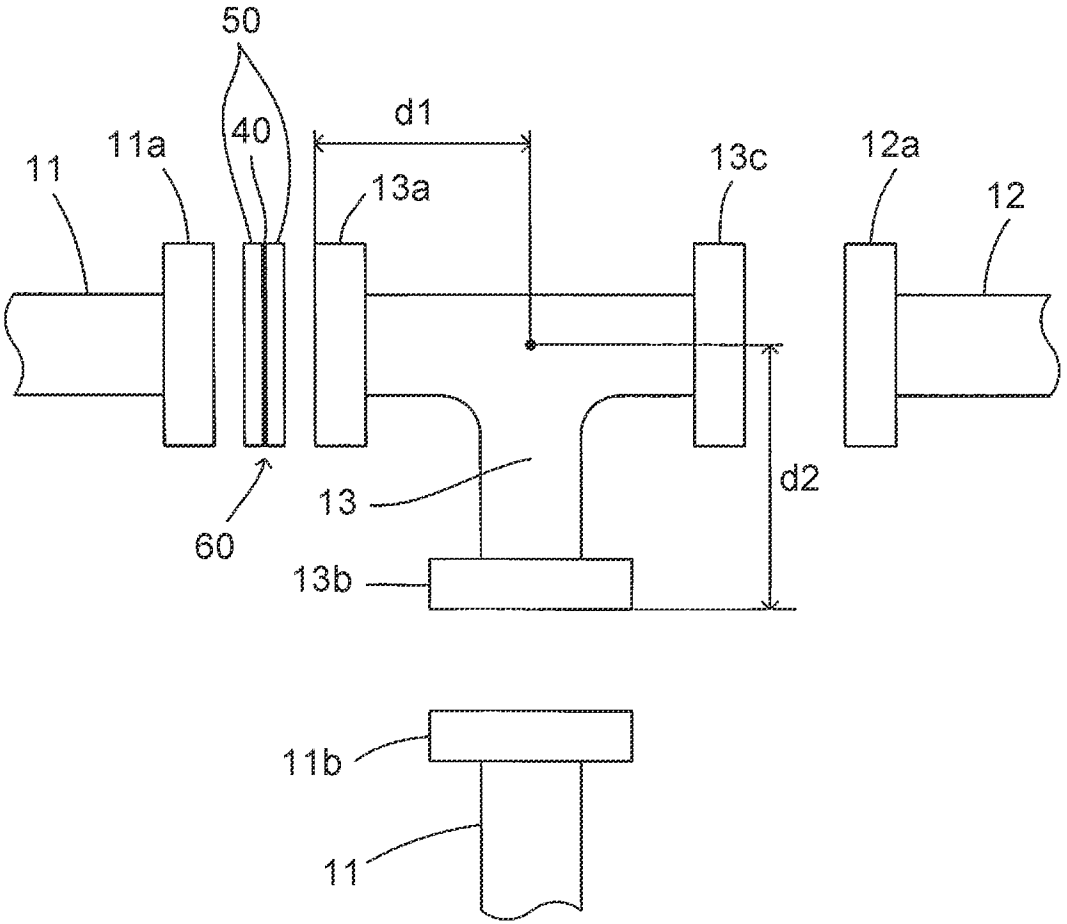
FIG. 5 is a diagram of a case where a blocking film sub-assembly is employed instead of a blocking film alone in the thermoacoustic temperature control system illustrated in FIG. 1, the diagram corresponding to FIG. 4.

Also, as illustrated in FIG. 5, instead of the blocking film 40 alone, a blocking film sub-assembly 60 may directly be inserted between the end portion 11*a* of the looped piping portion 11 and the connection end portion 13*a* of the three-way piping joint 13. The blocking film sub-assembly 60 is an integrated object including the blocking film 40 and a pair of annular holding members 50 that holds the blocking film 40 so as to sandwich the blocking film 40 from the opposite sides. The pair of holding members 50 can be fixed to the blocking film 40 using, for example, predetermined joining members (typically, bolts and nuts) and a predetermined adhesive.

As described above, where the blocking film sub-assembly 60 is employed, when the blocking film 40 is replaced, the blocking film sub-assembly 60 may be replaced instead of the blocking film 40 alone. In the blocking film sub-assembly 60, the blocking film 40 is protected by the pair of holding members 50, and thus, handling of the blocking film 40 is easy in comparison with the blocking film 40 alone. Therefore, in comparison with the case where the blocking film 40 is replaced alone, ease of the work of replacing the blocking film 40 is enhanced. Furthermore, in preparation for future replacement of the blocking film 40, a number of blocking films 40 can be kept not in the state of blocking films 40 alone but in the state of blocking film sub-assemblies 60. Therefore, ease of keeping the blocking films 40 is enhanced in comparison with the case where the blocking films 40 are kept alone.

The present invention is not limited only to the above-described typical embodiment and various applications and alterations are possible without departing from the object of the present invention. For example, each of the following modes to which the above-described embodiment is applied can be carried out.

In the above-described embodiment, as illustrated in FIG. 1, in a part of the looped piping portion 11, the part extending from the branching point p in a direction along the extension direction of the branch piping portion 12, the load 30 is disposed in such a manner that the low temperature-side end portion of the load 30 faces the branching point p, and the blocking film 40 is inserted in a position in the vicinity of branching point p, between the low temperature-side end portion of the load 30 and the branching point p. On the other hand, as illustrated in FIG. 6, a load 30 may be disposed in a part of a looped piping portion 11, the part extending from a branching point p in a direction orthogonal to an extension direction of a branch piping portion 12, in such a manner that a low temperature-side end portion of the load 30 faces the branching point p, and a blocking film 40 may be inserted at a position in the vicinity of the branching point p, between the low temperature-side end portion of the load 30 and the branching point p.

Figure 6:
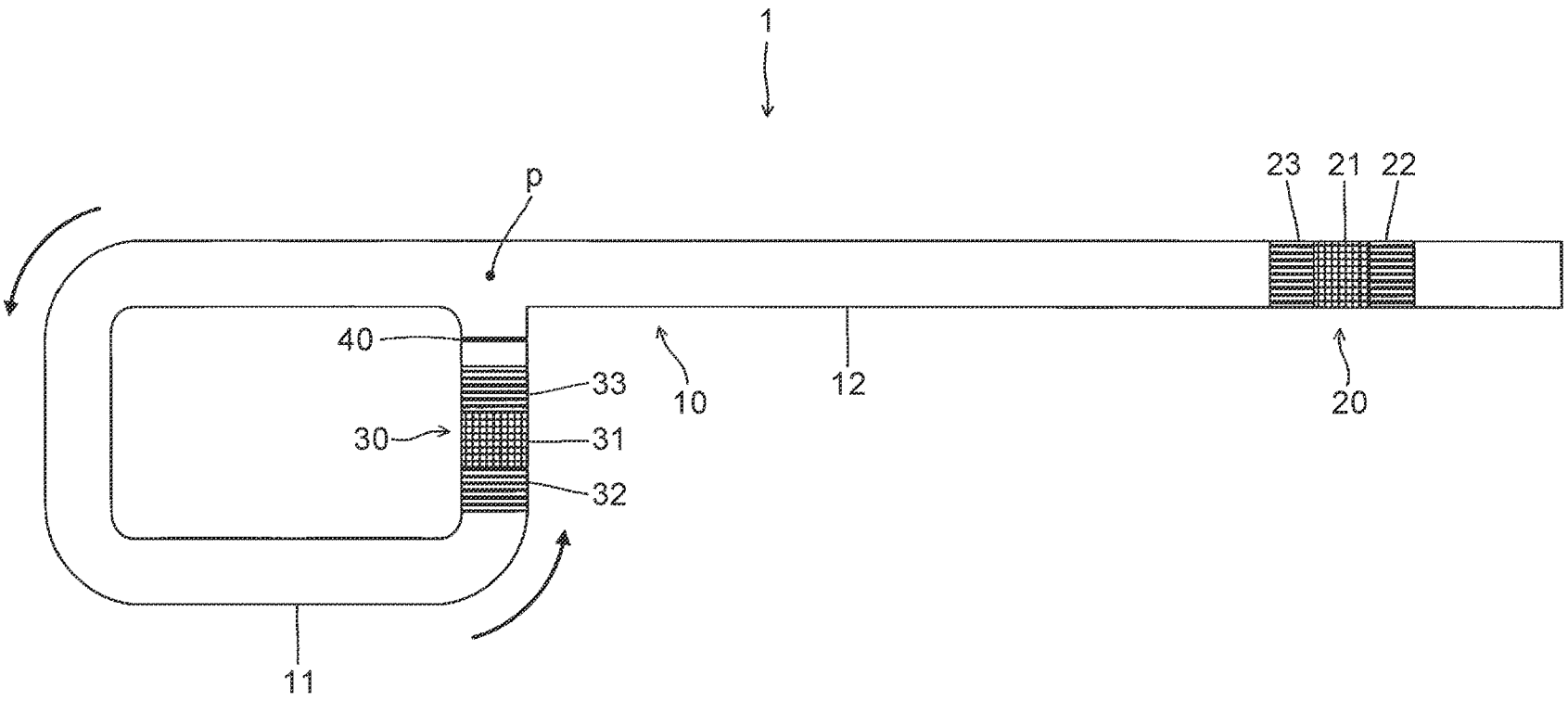
FIG. 6 is a diagram of a thermoacoustic temperature control system according to an alteration of the embodiment of the present invention, the diagram corresponding to FIG. 1.
Figure 7:
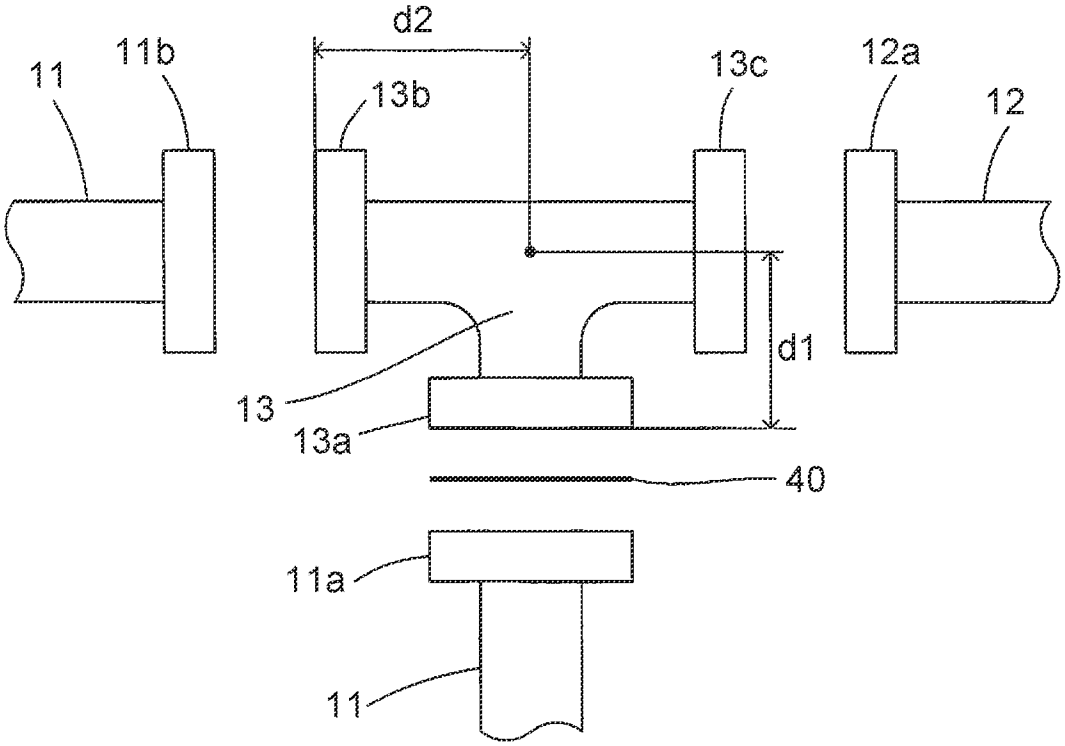
FIG. 7 is a diagram illustrating a specific configuration of piping around a branching point of the thermoacoustic temperature control system illustrated in FIG. 6.

In order to easily provide the configuration in which "the blocking film 40 is inserted at a position in the vicinity of the branching point p, in the looped piping portion 11" such as illustrated in FIG. 6, specifically, as illustrated in FIG. 7, a piping configuration using a three-way piping joint 13 around the branching point p can be employed.

In the example illustrated in FIG. 7, from among three connection end portions 13*a*, 13*b*, 13*c* of a T-shaped three-way piping joint 13, an end portion 12*a* of the branch piping portion 12 is connected to the connection end portion 13*c* corresponding to an end portion of a right-side arm portion of a right-left pair of linearly-extending arm portions of the T-shape, an end portion 11*b* of the looped piping portion 11 extending from a high temperature-side heat exchanger 32 toward the branching point p is connected to the connection end portion 13*b* corresponding to an end portion of a left-side arm portion of the T-shape, and an end portion 11*a* of the looped piping portion 11 extending from a low temperature-side heat exchanger 33 toward the branching point p is connected to the connection end portion 13*a* corresponding to an end portion of a leg portion of the T-shape. Then, the blocking film 40 is directly inserted between the end portion 11*a* of the looped piping portion 11 and the connection end portion 13*a* of the three-way piping joint 13.

This configuration also enables easily providing the configuration in which "the blocking film 40 is inserted at a position in the vicinity of the branching point p, in the looped piping portion 11" by the blocking film 40 being directly attached to the corresponding connection end portion 13*a* of the three-way piping joint.

Here, in the example illustrated in FIG. 7, also, it is preferable that a length d1, from the connection end portion 13*a* to the branching point p, of the three-way piping joint 13 be shorter than a length d2, from the connection end portion 13*b* to the branching point p, of the three-way piping joint 13. Consequently, the three-way piping joint 13, the length d1 of which is small, can be used, enabling the blocking film 40 to be brought further closer to the branching point p. As a result, the blocking film 40 can be inserted at a position at which acoustic energy becomes further smaller inside the looped piping portion 11, enabling further enhancement in durability of the blocking film 40.

Figure 8:
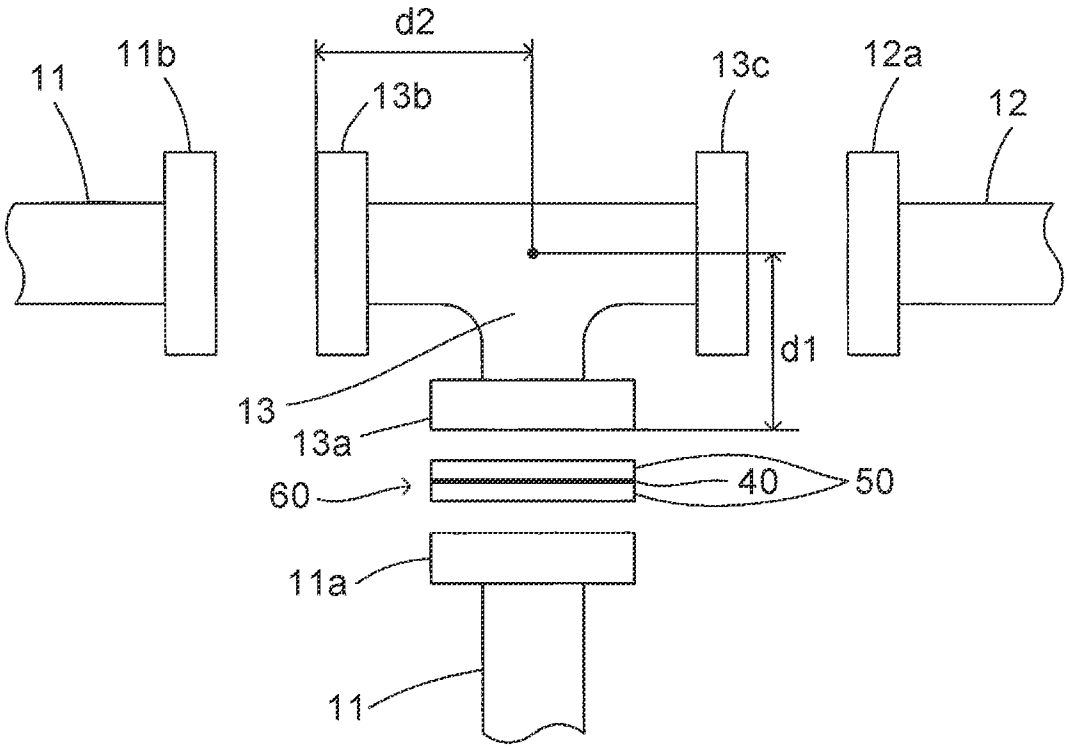
FIG. 8 is a diagram of a case where a blocking film sub-assembly is employed instead of a blocking film alone in the thermoacoustic temperature control system illustrated in FIG. 6, the diagram corresponding to FIG. 7.

Also, in the example illustrated in FIG. 7, as illustrated in FIG. 8, instead of the blocking film 40 alone, a blocking film sub-assembly 60 may directly be inserted between the end portion 11*a* of the looped piping portion 11 and the connection end portion 13*a* of the three-way piping joint 13.

Also, in various examples described above (FIGS. 1 and 6), the prime mover 20 is incorporated in the branch piping portion 12 with the end portion sealed. On the other hand, an additional looped piping portion including another branching point is formed at the end portion of the branch piping portion 12 branching from the branching point p of the looped piping portion 11 and the prime mover 20 may be incorporated in a part of the looped piping portion. In this case, in order to prevent generation of an acoustic mass flow of a working gas inside the looped piping portion, it is preferable to insert another blocking film in a part of the looped piping portion.

REFERENCE SIGNS LIST

1 THERMOACOUSTIC TEMPERATURE CONTROL SYSTEM
10 PIPING
11 LOOPED PIPING PORTION
11*a*, 11*b* END PORTION
12 BRANCH PIPING PORTION
12*a* END PORTION
13 THREE-WAY PIPING JOINT
13*a*, 13*b*, 13*c* CONNECTION END PORTION
20 PRIME MOVER
21 HEAT ACCUMULATOR (PRIME MOVER-SIDE HEAT ACCUMULATOR)
22 HIGH TEMPERATURE-SIDE HEAT EXCHANGER (PRIME MOVER-SIDE HEAT EXCHANGER)
23 LOW TEMPERATURE-SIDE HEAT EXCHANGER (PRIME MOVER-SIDE HEAT EXCHANGER)
30 LOAD
31 HEAT ACCUMULATOR (LOAD-SIDE HEAT ACCUMULATOR)
32 HIGH TEMPERATURE-SIDE HEAT EXCHANGER (LOAD-SIDE HEAT EXCHANGER)
33 LOW TEMPERATURE-SIDE HEAT EXCHANGER (LOAD-SIDE HEAT EXCHANGER)
40 BLOCKING FILM
50 HOLDING MEMBER
60 BLOCKING FILM SUB-ASSEMBLY

What is claimed is:

1. A thermoacoustic temperature control system comprising:

a piping with a working gas encapsulated therein;

a prime mover incorporated in the piping; and a load incorporated in the piping, the prime mover including a prime mover-side heat accumulator and prime mover-side heat exchangers connected to opposite end portions, in an extension direction of the piping, of the prime mover-side heat accumulator, the load including a load-side heat accumulator and load-side heat exchangers connected to opposite end portions, in the extension direction of the piping, of the load-side heat accumulator, in the prime mover, acoustic energy being generated inside the prime mover-side heat accumulator based on thermal energy provided from an outside to one of the prime mover-side heat exchangers, and in the load, the working gas having a predetermined temperature produced based on the acoustic energy transmitted to the load-side heat accumulator through the piping is supplied to the load-side heat accumulator, to adjust a temperature of an object connected to the load, wherein:

the piping includes a looped piping portion having a looped shape and a branch piping portion branching from a branching point that is a part of the looped piping portion;

the prime mover is incorporated in the branch piping portion and the load is incorporated in the looped piping portion;

a blocking film that prohibits the working gas from passing therethrough and is capable of vibrating along with vibration of the working gas is inserted at a position in a vicinity of the branching point, in a part of the looped piping portion between (i) one of the load-side heat exchangers that is on a low temperature side, the one of the load-side heat exchangers being connected to an end portion on a low temperature side of the opposite end portions, in the extension direction of the piping, of the load-side heat accumulator, and the (ii) branching point;

each of respective end portions of three parts of the piping, the three parts converging from three directions toward the branching point, are connected to a corresponding connection end portion of three connection end portions of a three-way piping joint; and the blocking film is directly inserted between an end portion of a part of the piping, the part extending from the one of the load-side heat exchangers that is on the low temperature side toward the branching point and the corresponding connection end portion of the connection end portions of the three-way piping joint.

2. The thermoacoustic temperature control system according to claim 1, wherein a length, from the connection end portion connected to the end portion of the part of the piping, the part extending from the one of the load-side heat exchangers that is on the low temperature side toward the branching point, to the branching point, of the three-way piping joint is shorter than a length, from the connection end portion connected to an end portion of a part of the piping, the part extending from one of the load-side heat exchangers that is on a high temperature side connected to an end portion on a high temperature side of the opposite end portions, in the extension direction of the piping, of the load-side heat accumulator, toward the branching point, to the branching point, of the three-way piping joint.

3. A thermoacoustic temperature control system comprising:

a piping with a working gas encapsulated therein;

a prime mover incorporated in the piping; and a load incorporated in the piping, the prime mover including a prime mover-side heat accumulator and prime mover-side heat exchangers connected to opposite end portions, in an extension direction of the piping, of the prime mover-side heat accumulator, the load including a load-side heat accumulator and load-side heat exchangers connected to opposite end portions, in the extension direction of the piping, of the load-side heat accumulator, in the prime mover, acoustic energy being generated inside the prime mover-side heat accumulator based on thermal energy provided from an outside to one of the prime mover-side heat exchangers, and in the load, the working gas having a predetermined temperature produced based on the acoustic energy transmitted to the load-side heat accumulator through the piping is supplied to the load-side heat accumulator, to adjust a temperature of an object connected to the load, wherein:

the piping includes a looped piping portion having a looped shape and a branch piping portion branching from a branching point that is a part of the looped piping portion;

the prime mover is incorporated in the branch piping portion and the load is incorporated in the looped piping portion;

a blocking film that prohibits the working gas from passing therethrough and is capable of vibrating along with vibration of the working gas is inserted at a position in a vicinity of the branching point, in a part of the looped piping portion between (i) one of the load-side heat exchangers that is on a low temperature side, the one of the load-side heat exchangers being connected to an end portion on a low temperature side of the opposite end portions, in the extension direction of the piping, of the load-side heat accumulator, and the (ii) branching point;

each of respective end portions of three parts of the piping, the three parts converging from three directions toward the branching point are connected to a corresponding connection end portion of three connection end portions of a three-way piping joint; and a blocking film sub-assembly including the blocking film and a pair of ring-like holding members that hold the blocking film so as to sandwich the blocking film from opposite sides is directly inserted between an end portion of a part of the piping, the part extending from the one of the load-side heat exchangers that is on the low temperature side toward the branching point and the corresponding connection end portion of the connection end portions of the three-way piping joint.

* * * * *